US006564026B2

(12) United States Patent
Uehara

(10) Patent No.: US 6,564,026 B2
(45) Date of Patent: May 13, 2003

(54) IMAGE FORMING APPARATUS HAVING A REMOVABLE ROLLER UNIT

(75) Inventor: Tadao Uehara, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/974,839

(22) Filed: Oct. 12, 2001

(65) Prior Publication Data

US 2002/0044792 A1 Apr. 18, 2002

(30) Foreign Application Priority Data

Oct. 13, 2000 (JP) ..... 2000-313292

(51) Int. Cl.[7] ..... G03G 15/20

(52) U.S. Cl. ..... 399/122; 219/216; 399/325; 399/329

(58) Field of Search ..... 399/122, 324–329; 219/216; 432/60

(56) References Cited

U.S. PATENT DOCUMENTS 4,421,401 A 12/1983 Kagiura et al.
5,026,276 A * 6/1991 Hirabayashi et al. ... 219/216 X
5,214,481 A 5/1993 Hoover
5,291,256 A * 3/1994 Kitajima et al. ..... 399/122
6,026,274 A 2/2000 Aslam et al. ..... 399/329
6,282,398 B1 * 8/2001 Higashi ..... 399/329

FOREIGN PATENT DOCUMENTS

JP 06-019344 1/1994
JP 09-218601 8/1997
JP 2000-066541 3/2000

OTHER PUBLICATIONS

European Search Report.

* cited by examiner

*Primary Examiner*—William J. Royer
(74) *Attorney, Agent, or Firm*—Oblon, Spivak, McClelland, Maier & Neustadt, P.C.

(57) ABSTRACT

An image forming apparatus includes an apparatus body, a heat roller, a fixing roller, a press roller pressed against the fixing roller, and endless belt passed over the heat roller and fixing roller, and a tension roller applying tension to the endless belt. The heat roller, fixing roller, endless belt and tension roller are constructed into a unit member, which is removably mounted to the apparatus body.

4 Claims, 1 Drawing Sheet

IMAGE FORMING APPARATUS HAVING A REMOVABLE ROLLER UNIT

BACKGROUND OF THE INVENTION

1. Field of the Invention

The present invention relates to a copier, laser printer, facsimile apparatus or similar image forming apparatus.

2. Description of the Background Art

Japanese Patent Laid-Open Publication No. 5-27623, for example, discloses an image forming apparatus including a fixing device generally made up of a heat roller, a fixing roller, an endless belt passed over the heat roller and fixing roller, a press roller pressed against the fixing roller with the intermediary of the belt, and a tension roller for applying tension to the belt. A paper sheet or similar recording medium carrying a toner image thereon is conveyed via a nip between the press roller and the belt, so that the toner image is fixed on the paper sheet. The heat roller or the press roller accommodates a halogen lamp or similar heater. A coating roller coats silicone oil on the belt in order to promote parting of the paper sheet from the belt after fixation.

In the image forming apparatus of the typed described, all the structural elements including the belt, heat roller, fixing roller, press roller, tension roller and coating roller are mounted on an apparatus body integrally with each other. This, coupled with the heater disposed in the heat roller or the press roller, increases the number of parts to assemble and complicates the structure. Further, the structural elements are difficult to handle because they are apt to break when the belt is inserted into the apparatus body or at the time of maintenance. Moreover, when the belt is replaced, the oil smears the operator's hand. The conventional apparatus is therefore not desirable from the production, assembly and maintenance standpoint.

Technologies relating to the present invention are also disclosed in, e.g., Japanese Patent Laid-Open publication No. 2000-66541.

SUMMARY OF THE INVENTION

It is therefore an object of the present invention to provide an image forming apparatus that promotes easy, efficient mounting of a fixing device to an apparatus body and facilitates the maintenance of the fixing device.

An image forming apparatus of the present invention includes an apparatus body, a heat roller, a fixing roller, a press roller pressed against the fixing roller, an endless belt passed over the heat roller and fixing roller, and a tension roller applying tension to the endless belt. The heat roller, fixing roller, endless belt and tension roller are constructed into a unit member, which is removably mounted to the apparatus body.

BRIEF DESCRIPTION OF THE DRAWING

The above and other objects, features and advantages of the present invention will become more apparent from the following detailed description taken with the accompanying drawing in which.

DESCRIPTION OF THE PREFERRED EMBODIMENT

Figure 1:
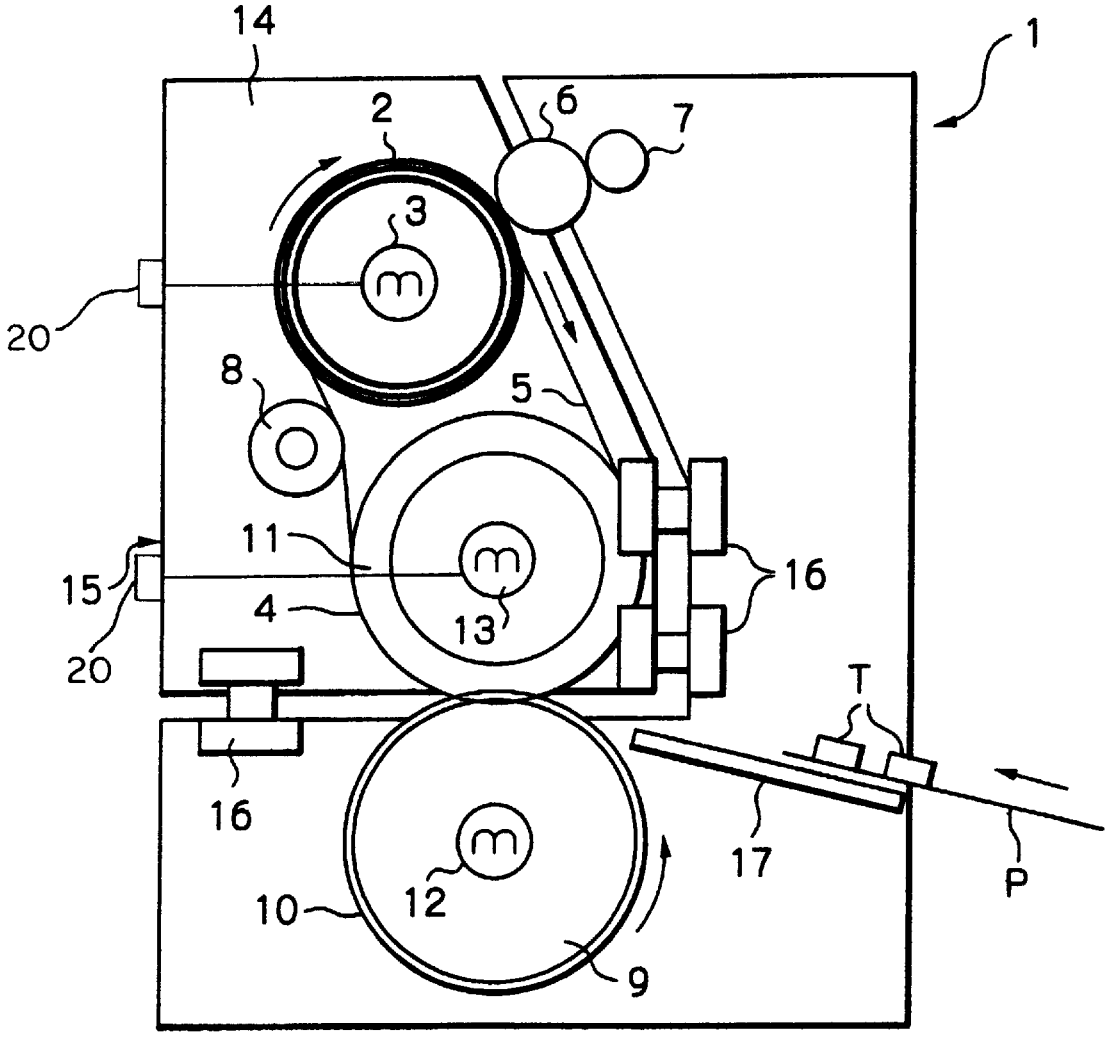
FIG. 1 is a sectional view showing an image forming apparatus embodying the present invention.

Referring to FIG. 1, an image forming apparatus embodying the present invention is shown and includes a casing 1.

The casing 1 accommodates a heat roller 2, a fixing roller 4, an endless belt 5, a coating roller 6, an oil feed roller 7, a tension roller 8, and a press roller 9. Heaters 3 and 13 are disposed in the heat roller 2 and fixing roller 4, respectively. It is noted that only one of the two heaters 3 and 13 suffices for heating the belt 5. A rubber layer 11 covers the surface of the fixing roller 4. The belt 5 is passed over the heat roller 2 and fixing roller 4. The coating roller 6 coats oil on the surface of the belt 5 while the oil feed roller 7 feeds the oil to the coating roller 6. The tension roller 8 applies tension to the belt 5. A rubber layer 10 is formed on the surface of the press roller 9. A heater 12 is disposed in the press roller 9. The fixing roller 4 and press roller 9 are pressed against each other with the intermediary of the belt 5.

The belt 5, fixing roller 4, heat roller 2 and tension roller 8 are constructed into a unit and removably mounted to a support 14, constituting a unit member 15. The unit member 15 is removably mounted to the casing or apparatus body 1 by three fixing members 16 at one side, i.e., six fixing members 16 at both sides.

The belt 5 has a base formed of polyimide resin or SUS (chrome stainless steel as prescribed by JIS (Japanese Industrial Standards)), nickel or similar metal. A silicone rubber layer covers the surface of the base and plays the role of a parting layer. The coating roller 6 is positioned upstream of the fixing roller 4 in the direction of movement of the belt 5 in order to feed the oil to the belt 5, thereby promoting parting of a paper sheet or similar recording medium. Also, the tension roller 8 is positioned downstream of the fixing roller 4 so as not to affect the coating of the oil.

In operation, the heat roller 2 heats the belt 5, which is running in a direction indicated by an arrow in FIG. 1. A paper sheet or similar recording medium P carrying a toner image T, which is formed by a conventional image forming process, is conveyed to a nip between the belt 5 and the press roller 9 along a guide 17. The belt 5 and press roller 9 press the paper sheet P therebetween with the result that the toner image T is fixed on the paper sheet P by heat and pressure. The paper sheet P coming out of the above nip is driven out of the apparatus body 1.

As stated above, in the illustrative embodiment, the heat roller 2, fixing roller 4, belt 5 and tension roller 8 are constructed into a single unit member 15. The unit member 15 is removably mounted to the apparatus body 1 by the fixing members 16. Terminals 20 for connecting the heaters 3 and 13 are also arranged on the unit member 15. This reduces the number of parts to be assembled on the apparatus body 1 and thereby simplifies the overall structure of the apparatus while promoting easy production and assembly.

Further, maintenance, e.g., the replacement of the belt 5 can be performed only if the unit member 15 is removed from the apparatus body 1. The operator is therefore free from smears and can easily perform maintenance. Moreover, such a simple structure protects the structural parts from damage otherwise occurring when the belt 5 is inserted into the apparatus body 1. In addition, the oil feed roller 7 is mounted on the apparatus body 1 and reduces the number of parts of the unit member 15.

It is to be noted that the number of fixing members 16 is, of course, open to choice.

In summary, it will be seen that the present invention provides an image forming apparatus having various unprecedented advantages, as enumerated below.

(1) At least a belt, a heat roller, a fixing roller and a tension roller are constructed into a single unit member, which is removably mounted to the apparatus body. This reduces the number of parts to be assembled on the apparatus body and thereby simplifies the overall structure of the apparatus while facilitating the replacement of parts. The apparatus is therefore easy to handle and assemble at the time of production (2) Terminals for connecting a heater disposed in at least one of the heat roller and fixing roller are arranged on the unit member. This facilitates the removable of the unit member from the apparatus body and further reduces the number of parts to be assembled on the apparatus body. Consequently, the structure of the apparatus is further simplified and becomes easier to handle and assemble at the time of production. In addition, such a simple structure protects the structural parts from damage otherwise occurring when the belt is inserted into the apparatus body.

(3) An oil coating mechanism is mounted on the apparatus body and allows its coating roller and oil feed roller to be accurately positioned, further enhancing easy production and assembly. In addition, the replacement of the belt or similar maintenance can be performed only if the unit member is removed from the apparatus body, freeing the operator from smears.

Various modifications will become possible for those skilled in the art after receiving the teachings of the present disclosure without departing from the scope thereof.

What is claimed is:

1. An image forming apparatus comprising:

an apparatus body;

a heat roller;

a fixing roller;

a press roller pressed against said fixing roller;

an endless belt passed over said heat roller and said fixing roller;

a tension roller applying tension to said endless belt; and coating means for coating oil on said endless belt, said coating means being fixedly mounted to said apparatus body, wherein said heat roller, said fixing roller, said endless belt and said tension roller are constructed into a unit member, which is removably mounted to said apparatus body.

2. The apparatus as claimed in claim 1, wherein at least one of said heat roller and said fixing roller accommodates a heater therein.

3. The apparatus as claimed in claim 2, further comprising a terminal for connecting said heater.

4. The apparatus as claimed in claim 3, wherein said terminal is arranged on said unit member.

* * * * *